US009757844B2

(12) United States Patent
Chen

(10) Patent No.: US 9,757,844 B2
(45) Date of Patent: Sep. 12, 2017

(54) ONE-WAY WRENCH HAVING A CATCHING DEVICE WITH TWO CATCHES AND A CATCH HOLDER AND HAVING DIFFERENTIAL TEETH

(71) Applicant: INFAR INDUSTRIAL CO., LTD., Chang-Hwa (TW)

(72) Inventor: Ander Chen, Chang-Hwa (TW)

(73) Assignee: Infar Industrial Co., Ltd., Fu-Shing Chang Hwa (TW)

( * ) Notice: Subject to any disclaimer, the term of this patent is extended or adjusted under 35 U.S.C. 154(b) by 337 days.

(21) Appl. No.: 14/625,096

(22) Filed: Feb. 18, 2015

(65) Prior Publication Data

US 2016/0236328 A1 Aug. 18, 2016

(51) Int. Cl.
*B25B 13/46* (2006.01)
*B25B 13/04* (2006.01)

(52) U.S. Cl.
CPC ..... *B25B 13/463* (2013.01); *B25B 13/04* (2013.01)

(58) Field of Classification Search
CPC ..... B25B 13/461; B25B 13/463; B25B 1/481
See application file for complete search history.

(56) References Cited

U.S. PATENT DOCUMENTS 7,178,429 B2 * 2/2007 Lin ..... B25B 13/463 81/58
8,272,297 B1 * 9/2012 Chen ..... B25B 13/463 81/60
9,120,211 B2 * 9/2015 Huang ..... B25B 13/463 81/60
2013/0269488 A1 * 10/2013 Huang ..... B25B 13/463 81/60
2015/0196994 A1 * 7/2015 Huang ..... B25B 13/04 81/60
2016/0354903 A1 * 12/2016 Huang ..... B25B 13/463 81/63.1

* cited by examiner

*Primary Examiner* — David B Thomas
(74) *Attorney, Agent, or Firm* — Wang Law Firm, Inc.

(57) ABSTRACT

A one-way wrench having a catching device with two catches and a catch holder and having differential teeth is provided and characterized in that: the catching device is disposed in a catching chamber laterally disposed beside a driving hole of the one-way wrench; the catching device has two catches, two position-restoring elements, and a catch holder; the catch holder pushes the two catches simultaneously, such that a single stable base structure pushes the two catches simultaneously; and starting ends of tooth portions of the two catches are dentate to different extents, so as to effectuate a small transmission-oriented tooth-changing angle, achieve stable control, as well as cut production and maintenance costs.

3 Claims, 9 Drawing Sheets

ONE-WAY WRENCH HAVING A CATCHING DEVICE WITH TWO CATCHES AND A CATCH HOLDER AND HAVING DIFFERENTIAL TEETH

BACKGROUND OF THE INVENTION

Technical Field

The present invention relates to a wrench catching device driven in a single direction, characterized in that the catching device has two catches operating in the same direction.

Description of Related Art

Wrenching tools nowadays are sophisticated. Among them, a one-way wrench structure is simple and durable, as its structure is characterized mostly in that: a driving element for use with a ratchet wheel is disposed in a driving hole; and the driving element is externally provided with ratchet teeth operating in conjunction with a catching device. However, the number of ratchet teeth is subjected to a strength-related limit, i.e., a maximum of 72. That is to say, in the situation where the driving element has more than 72 ratchet teeth, each of the ratchet teeth is overly small; as a result, not only are the ratchet teeth incapable of transmitting a driving force exerted thereon, but the ratchet teeth are also likely to get damaged. Hence, the driving element has a minimum tooth-changing angle of 5° approximately. Due to the aforesaid limitation, the wrench fails to work in a driving operation environment where the tooth-changing angle is less than 5°.

To address the aforesaid issue, wrench manufacturers develop a catching device with two catches, which is shown in FIG. 1 and characterized in that: a driving hole 11 is disposed in a wrench body 10 and adapted to receive a driving element 20; the driving hole 11 is flanked by two catching chambers 12; two catching devices A each have a catch 30 and a position-restoring element 40 which get engaged with the driving element 20 at different timing to effectuate engagement by increasing the number of ratchet teeth twofold and reduce the transmission-oriented tooth-changing angle by 50%, such that a wrench with the catching device can operate in circumstances which require a small transmission-oriented tooth-changing angle. However, the aforesaid structure necessitates the two catching chambers 12 and thus renders its operation intricate. Furthermore, one end of each of the position-restoring elements 40 of the two catching devices A abuts against the catches 30, whereas the other end of each of the position-restoring elements 40 of the two catching devices A abuts against the curved wall of the catching chambers 12. The catching chambers 12 are curved and increasingly shallower. The position-restoring elements 40 are capable of thrusting resiliently to thereby move spontaneously toward the shallower ends of the catching chambers 12 and even end up in the gap between the catching chamber 12 and the driving element 20, thereby causing the driving element 20 to get stuck. Therefore, there is still room for improvement of the prior art.

BRIEF SUMMARY OF THE INVENTION

The present invention provides a one-way wrench having a catching device with two catches and a catch holder and having differential teeth to simplify a wrench body structure and effectuate the following features and advantages: two catches are disposed in the same catching chamber; starting ends of tooth portions are dentate to different extents; the catch holder hold two position-restoring elements for catching the two catches; hence, costs incurred in processing the wrench body as well as manufacturing and maintaining the catching device are reduced; and thus the objectives of stable driving as well as quick installation are achieved.

In order to achieve the above and other objectives, the present invention provides a one-way wrench having a catching device with two catches and a catch holder and having differential teeth, characterized in that: the wrench has a body, a driving element, and a catching device; the catching device has two catches, two position-restoring elements, and a catch holder, wherein an end of the body has a driving hole, wherein a catching chamber is laterally disposed beside the driving hole and is in communication with the driving hole, wherein the catching chamber is shallow at its two ends and deep at its middle; the driving element is externally provided with ratchet teeth and internally provided with a penetrated driving hole; the two catches have abutting ends abutting against the catching chamber, respectively; the two catches have tooth portions corresponding in position to end surfaces of the ratchet teeth, respectively; wherein a starting end of the tooth portion of one of the two catches looks like a trough, whereas a starting end of the tooth portion of another one of the two catches looks like a peak; the tooth portion of one of the two catches is ahead of or lags behind the tooth portion of another one of the two catches by a half-tooth distance, wherein only one catch is engaged with and driven by the ratchet teeth of the driving element; an end of each of the two position-restoring elements abuts against a corresponding one of the two catches, whereas another end of each of the two position-restoring elements abuts against the catch holder; the catch holder has an abutting surface for abutting against the catching chamber, wherein the catch holder has an end surface corresponding in position to the catches and adapted to abut against the two position-restoring elements, wherein the other ends of the two position-restoring elements abut against the catches.

In order to achieve the above and other objectives, the present invention further provides another one-way wrench having a catching device with two catches and a catch holder and having differential teeth, characterized in that: the wrench has a body, a driving element, and a catching device; the catching device has two catches, two position-restoring elements, and a catch holder, wherein an end of the body has a driving hole, wherein a catching chamber is laterally disposed beside the driving hole and is in communication with the driving hole, wherein the catching chamber is shallow at its two ends and deep at its middle; the driving element is externally provided with ratchet teeth and internally provided with a penetrated driving hole; the two catches have abutting ends abutting against the catching chamber, respectively; the two catches have tooth portions corresponding in position to end surfaces of the ratchet teeth, respectively; wherein a starting end of the tooth portion of one of the two catches looks like a trough, whereas a starting end of the tooth portion of another one of the two catches looks like a peak; the tooth portion of one of the two catches is ahead of or lags behind the tooth portion of another one of the two catches by a half-tooth distance, wherein only one catch is engaged with and driven by the ratchet teeth of the driving element; an end of each of the two position-restoring elements abuts against a corresponding one of the two catches, whereas another end of each of the two position-restoring elements abuts against the catch holder; the catch holder has an abutting surface for abutting against the catching chamber and has a positioning portion corresponding in position to the two position-restoring elements and adapted to position the two position-restoring elements in place, such that the two position-restoring elements are positioned precisely at the catch holder, and the two position-restoring elements abut precisely against the catches, respectively.

The positioning portions of the catch holder and the catches each have a mounting portion and an inserting portion, such that the position-restoring elements are fixed in place between the catch holder and the catches as soon as tips of end portions of the position-restoring elements are inserted into the positioning portions to thereby get engaged and positioned.

The positioning portion is a recess-shaped structure, whereas the mounting portion is a hollow-core recess structure, wherein the inserting portion is disposed at an opening of the mounting portion to render the opening narrow.

The positioning portion is a cylindrical structure, whereas the mounting portion is a thin-waist cylinder, wherein the inserting portion is disposed at a terminal end of the mounting portion and forms a radial protruding structure.

DETAILED DESCRIPTION OF THE INVENTION

Figure 1:
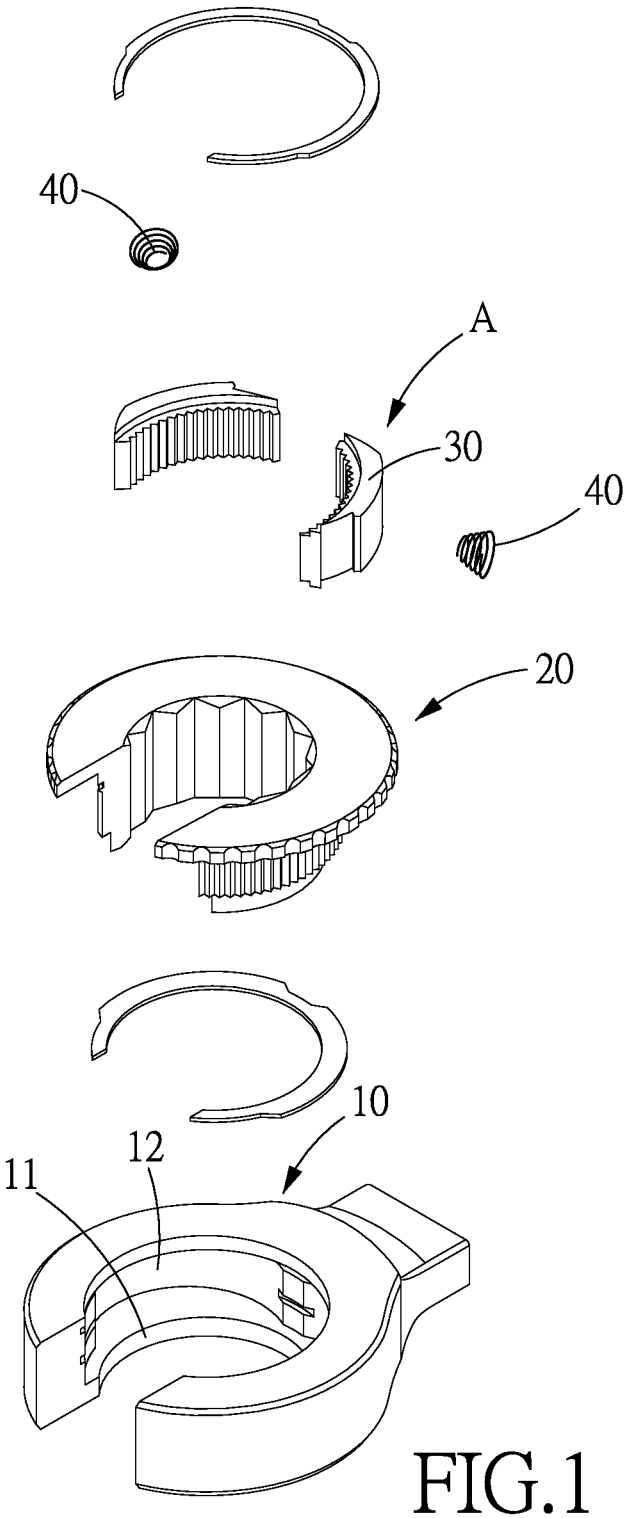
FIG.1 PRIOR ART
FIG. 1 (prior art) is an exploded view of a conventional wrench with two catches.
Figure 2:
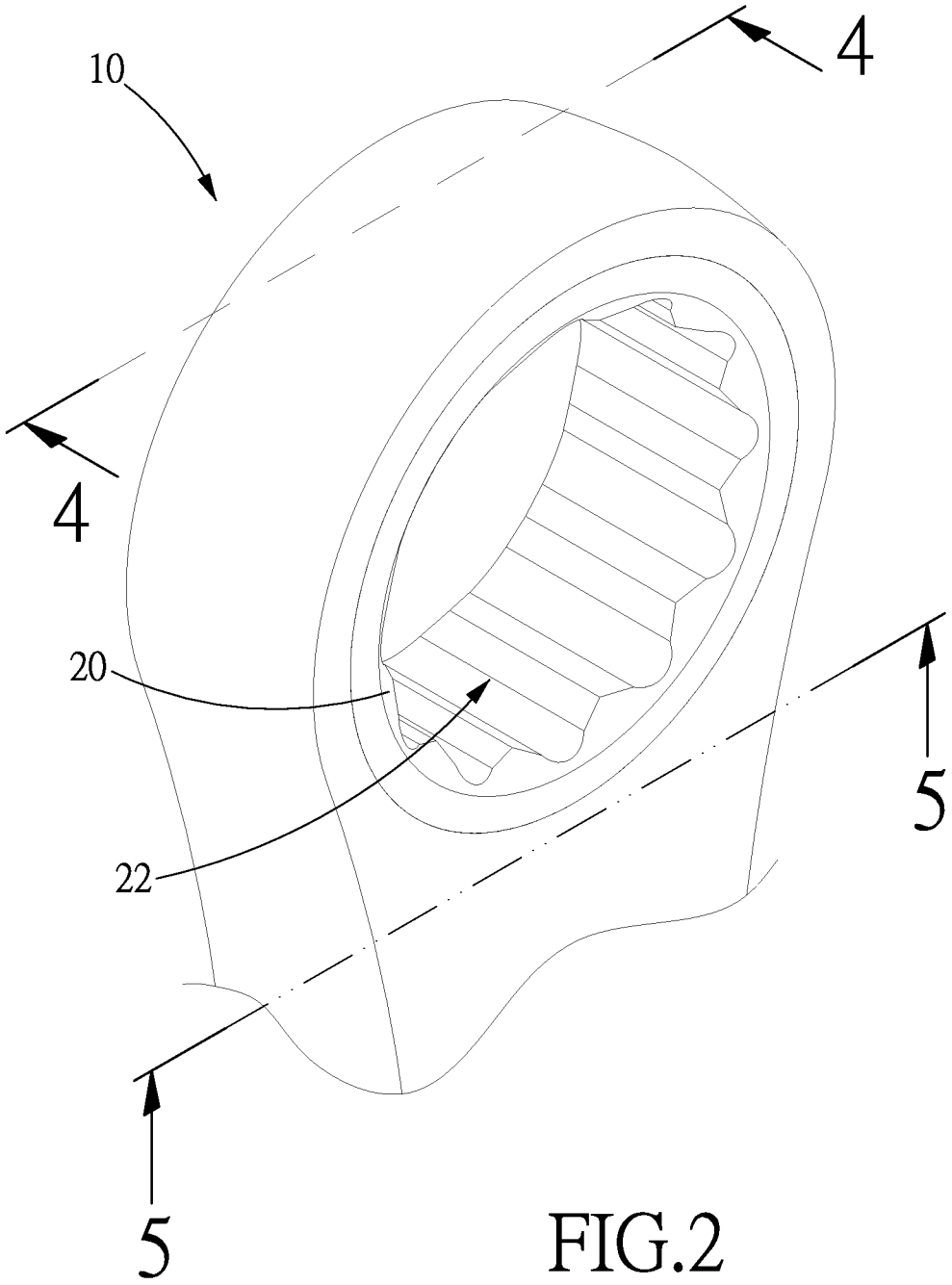
FIG. 2 is a schematic view of one-way wrench assembled according to the present invention.
Figure 3:
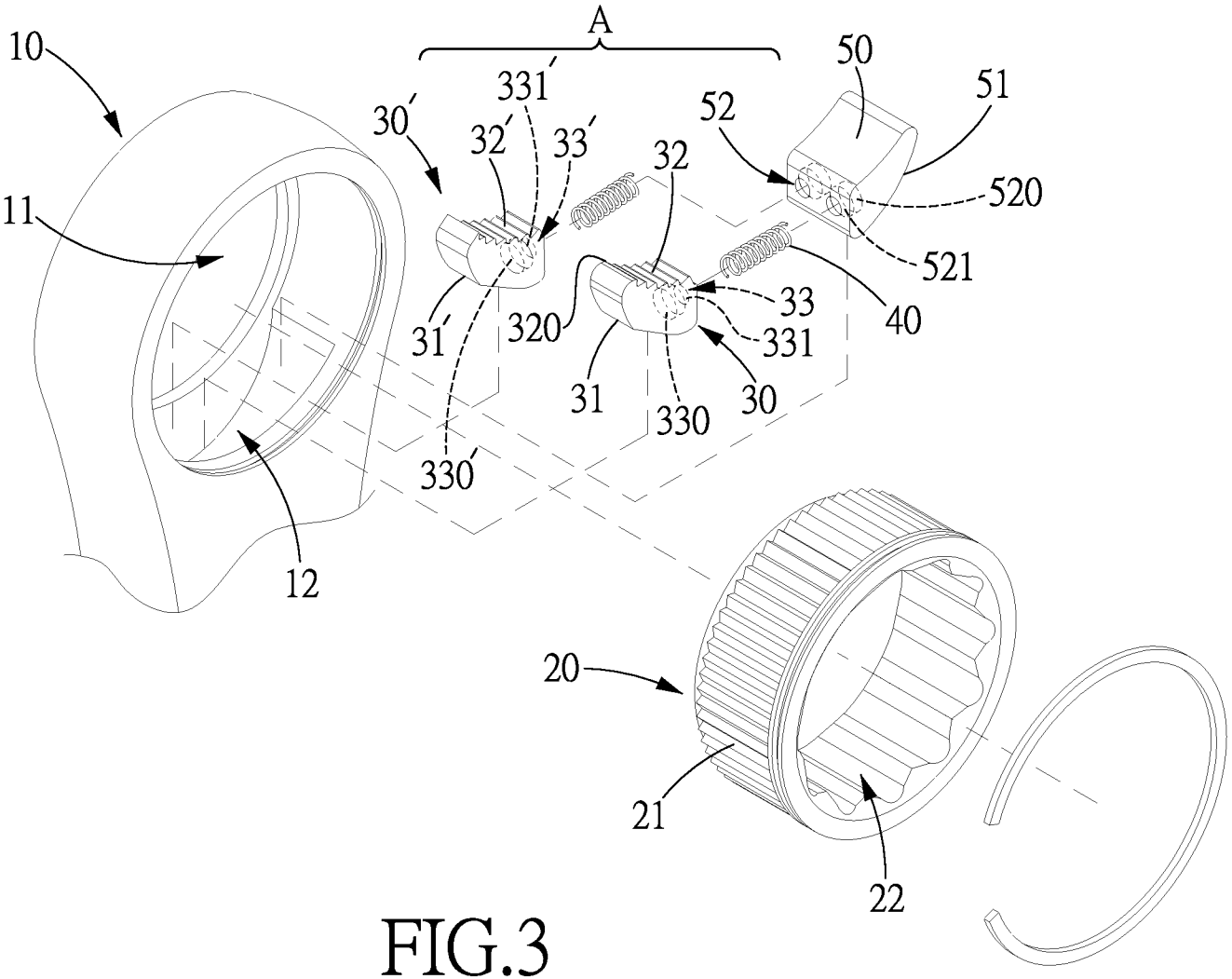
FIG. 3 is a schematic view of one-way wrench three-dimensional system assembled according to the present invention.
Figure 4:
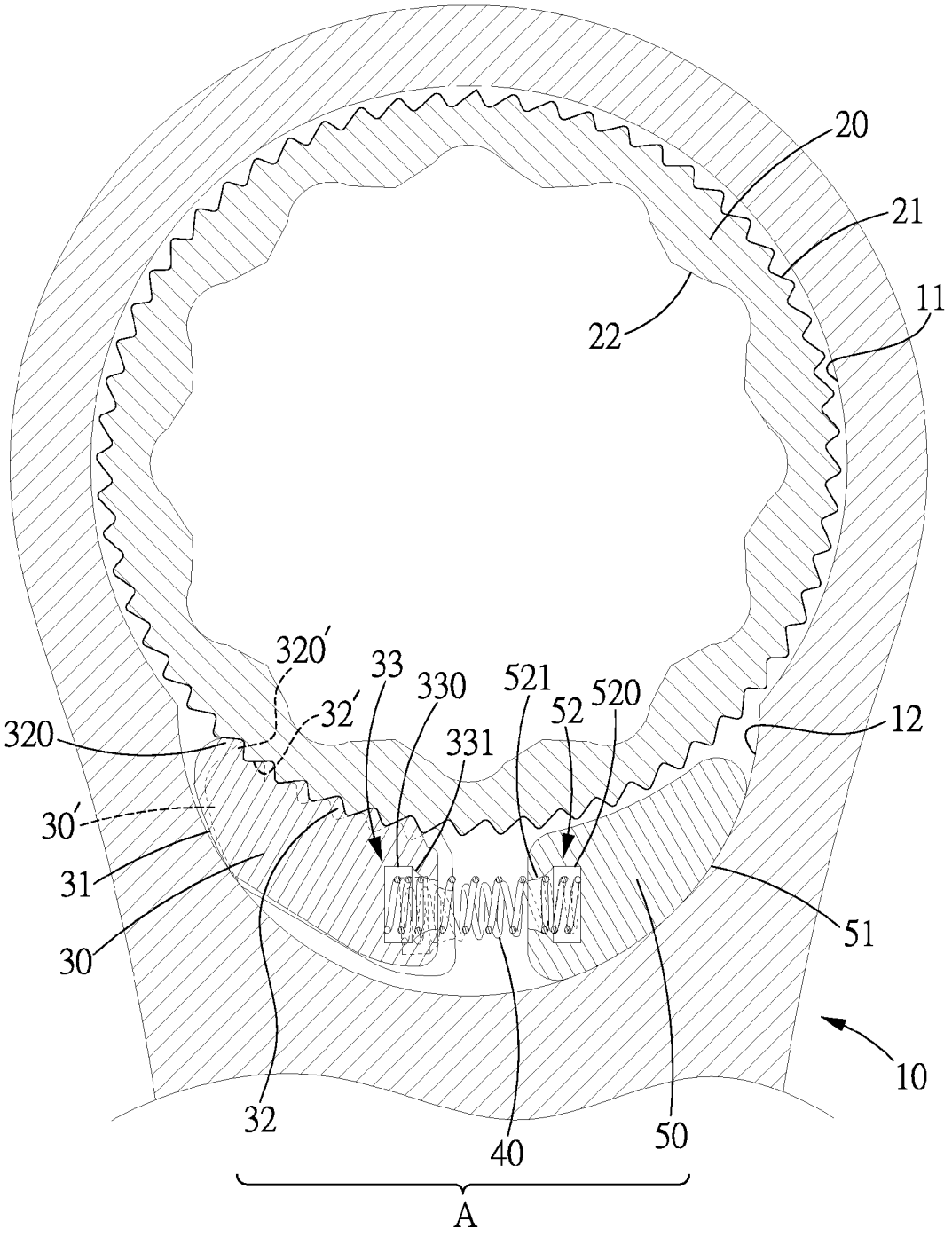
FIG. 4 is a cross-sectional view taken along line 23-3 of FIG. 2 according to the present invention.

A preferred embodiment of a one-way wrench structure of the present invention is illustrated with FIGS. 1 through 4 and described below.

The wrench has a body 10, a driving element 20, and a catching device A disposed in the body 10. The catching device A has two catches 30, 30', two position-restoring elements 40, and a catch holder 50. One end of the body 10 has a driving hole 11. A catching chamber 12 is laterally disposed beside the driving hole 11 and is in communication with the driving hole 11. The catching chamber 12 is shallow at its two ends and deep at its middle. The driving element 20 is externally provided with ratchet teeth 21 and internally provided with a penetrated driving hole 22 for driving a workpiece to rotate along with the wrench. The present invention has an essential technical feature, that is, one catching chamber 12 contains the catching device A which has two catches 30, 30', two position-restoring elements 40, and one catch holder 50.

The two catches 30, 30' of the catching device A have abutting ends 31, 31' which abut against the catching chamber 12, respectively. The two catches 30, 30' of the catching device A have tooth portions 32, 32' which correspond in position to the end surfaces of the ratchet teeth 21, respectively. A starting end 320 of the tooth portion 32 of the catch 30 looks like a trough, whereas the starting end of the tooth portion 32' of the catch 30' looks like a peak. The tooth portion 32 of the catch 30 is ahead of or lags behind the tooth portion 32' of the catch 30' by a half-tooth distance. Only one catch 30 (30') is engaged with and driven by the ratchet teeth 21 of the driving element 20. Positioning portions 33, 33' are disposed at the two catches 30, 30' and correspond in position to the two position-restoring elements 40, respectively, such that end portions of the position-restoring elements 40 are positioned in place. The positioning portions 33, 33' are each a recess-shaped structure. Mounting portions 330, 330' are disposed at the bottoms of the recesses of the positioning portions 33, 33', respectively. Inserting portions 331, 331', which protrude inward, are disposed at openings of the mounting portions 330, 330', respectively, such that the openings of the positioning portions 33, 33' are narrow because of the inserting portions 331, 331'. Hence, terminal ends of the position-restoring elements 40 reach the mounting portions 330, 330' to thereby get engaged with the inserting portions 331, 331' and fixed in place, as soon as opposite end portions of the position-restoring elements 40 are inserted into the positioning portions 33, 33', respectively.

One end of each of the two position-restoring elements 40 abuts against a corresponding one of the catches 30, 30', whereas the other end of each of the two position-restoring elements 40 abuts against the catch holder 50.

The catch holder 50 has an abutting surface 51 for abutting against the catching chamber 12 and has a positioning portion 52 corresponding in position to the two position-restoring elements 40 and adapted to position the two position-restoring elements 40 in place, such that the two position-restoring elements 40 are positioned precisely at the catch holder 50, and the two position-restoring elements 40 abut precisely against the catches 30, 30', respectively. The positioning portion 52 is a recess-shaped structure. A mounting portion 520 is disposed at the bottom of the recess of the positioning portion 52. An inserting portion 521, which protrudes inward, is disposed at an opening of the mounting portion 520, such that the opening of the positioning portion 52 is narrow because of the inserting portion 521. Hence, terminal ends of the position-restoring elements 40 reach the mounting portion 520 to thereby get engaged with the inserting portion 521 and fixed in place, as soon as opposite end portions of the position-restoring elements 40 are inserted into the positioning portion 52 of the catch holder 50.

Figure 5:
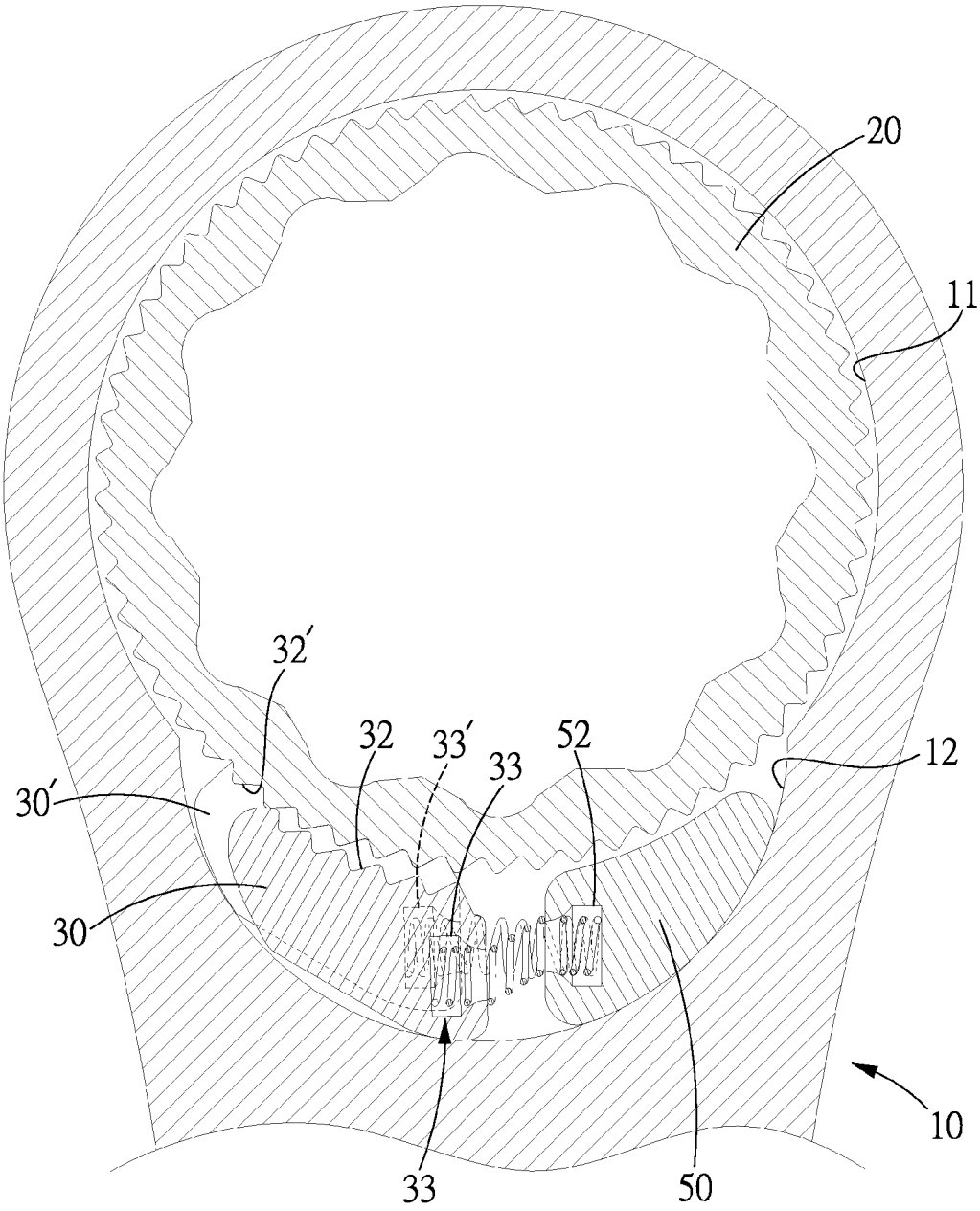
FIG. 5 is an operation schematic view of FIG. 4 according to the present invention.
Figure 6:
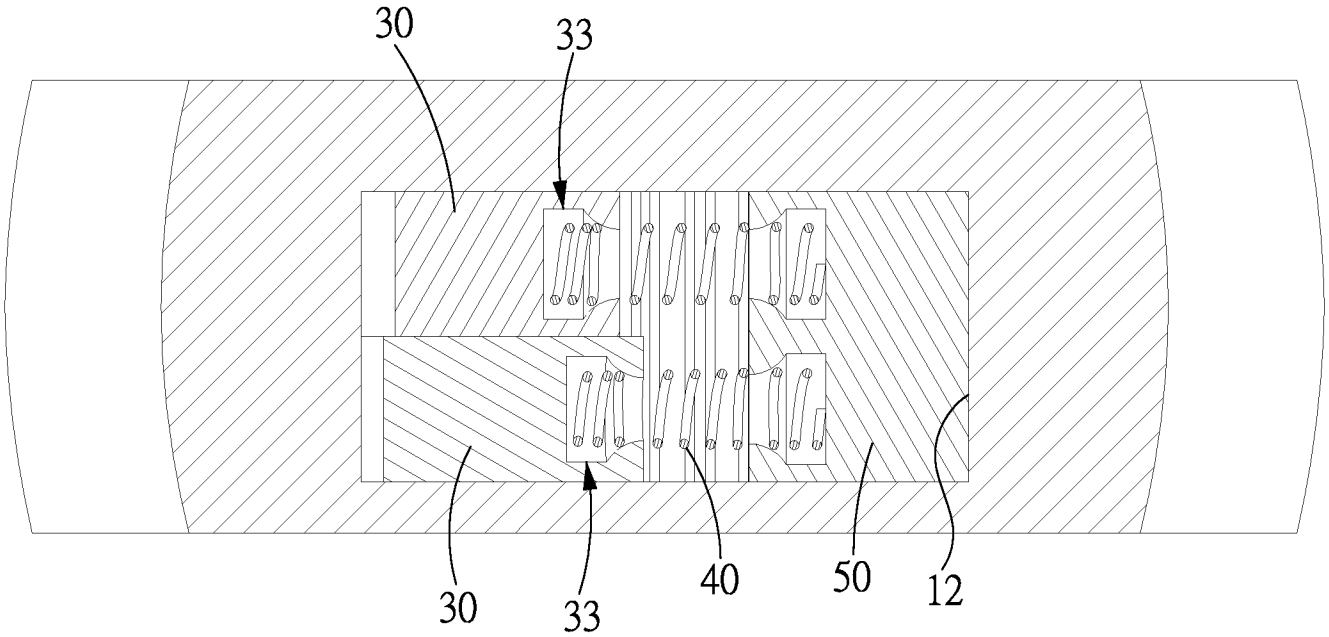
FIG. 6 is a cross-sectional view taken along line 25-5 of FIG. 2 according to the present invention.

Therefore, after being assembled, the catching device A is directly put in the catching chamber 12 of the wrench body 10. When the wrench body 10 begins to operate, the two catches 30, 30' catch the ratchet teeth 21 of the driving element 20 not concurrently (by switching from the operating mode shown in FIG. 4 to the operating mode shown in FIG. 5). With the catches 30, 30' working not simultaneously, a small transmission-oriented tooth-changing angle is feasible. Furthermore, it is convenient to install the catching device A. Referring to FIG. 6, the two catches 30, 30' are disposed in the same catching chamber 12 and stacked up therein, thereby dispensing with the hassles of providing a second catching chamber. Hence, the processing cost of the wrench body 10 is minimized. Moreover, it is quick and easy to install, repair, and change the catching device A. Therefore, the one-way wrench of the present invention involves an inventive step.

Figure 7:
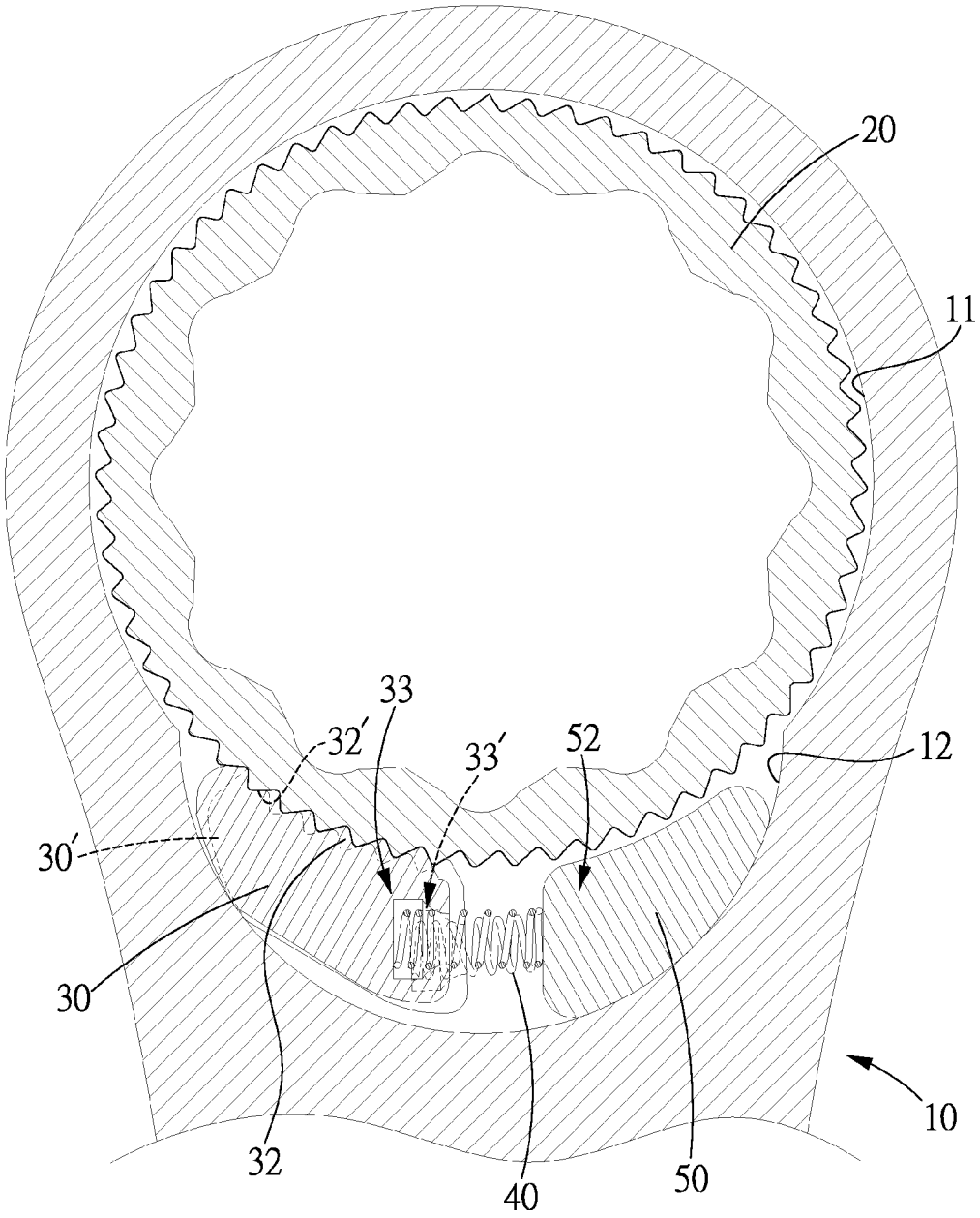
FIG. 7 is a cross-sectional view of an embodiment where the catch holder of the catching device does not have a positioning portion according to the present invention.
Figure 8:
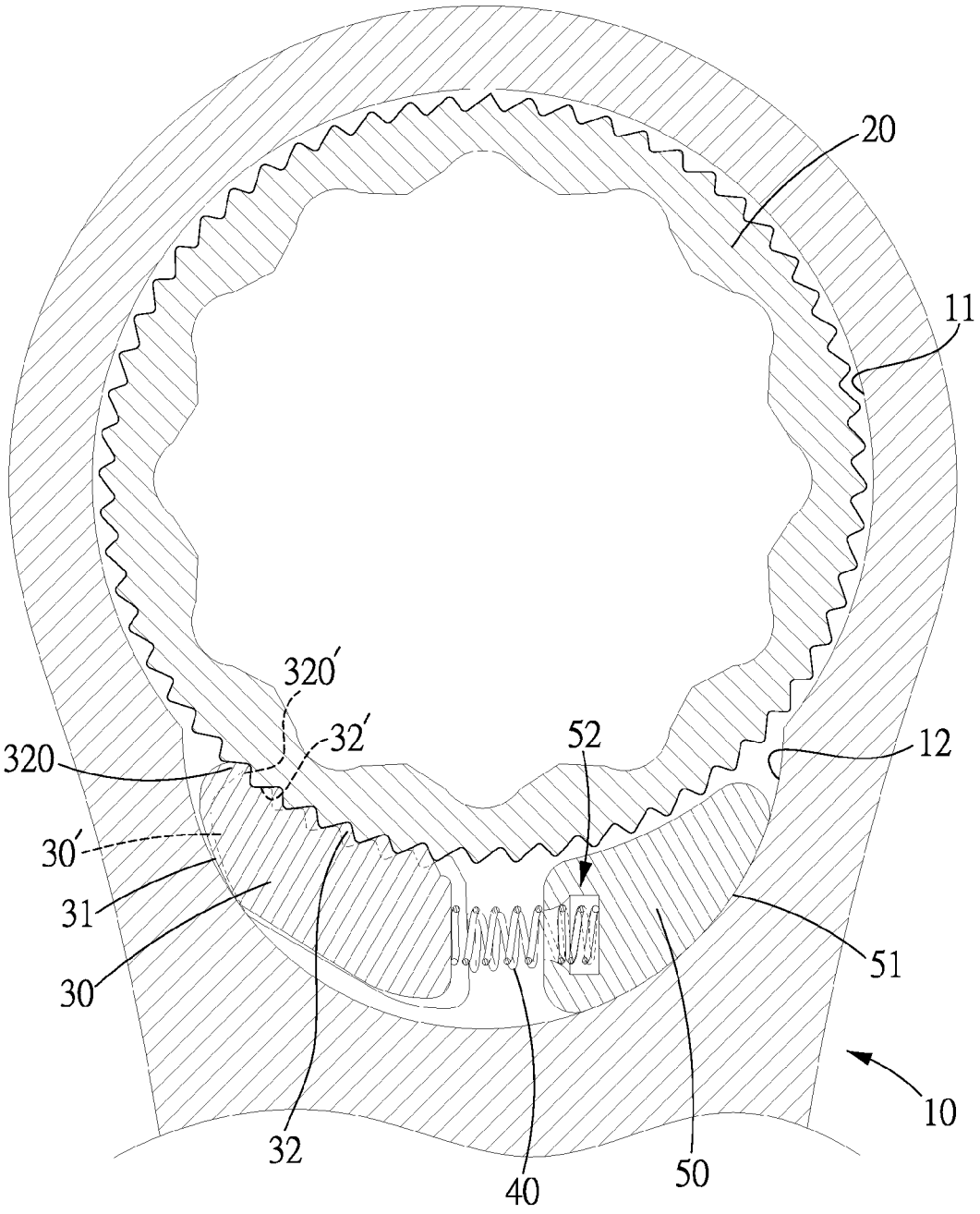
FIG. 8 is a cross-sectional view of the embodiment where the catches of the catching device do not have a positioning portion according to the present invention.

Referring to FIGS. 7, 8, the positioning portions 33, 33' and the positioning portion 52 can be the alternative to each other. If the positioning portions 33, 33' are disposed at the two catches 30, 30', respectively, the catch holder 50 can dispense with the positioning portion 52. Conversely, if the two catches 30, 30' lack the positioning portions 33, 33', respectively, the catch holder 50 can have the positioning portion 52. Due to the aforesaid alternative options, at least one end of each of the two position-restoring elements 40 is positioned and supported by a corresponding one of the positioning portions 33, 33', 52 to thereby stay at the best position for abutting against the position-restoring elements 40.

Figure 9:
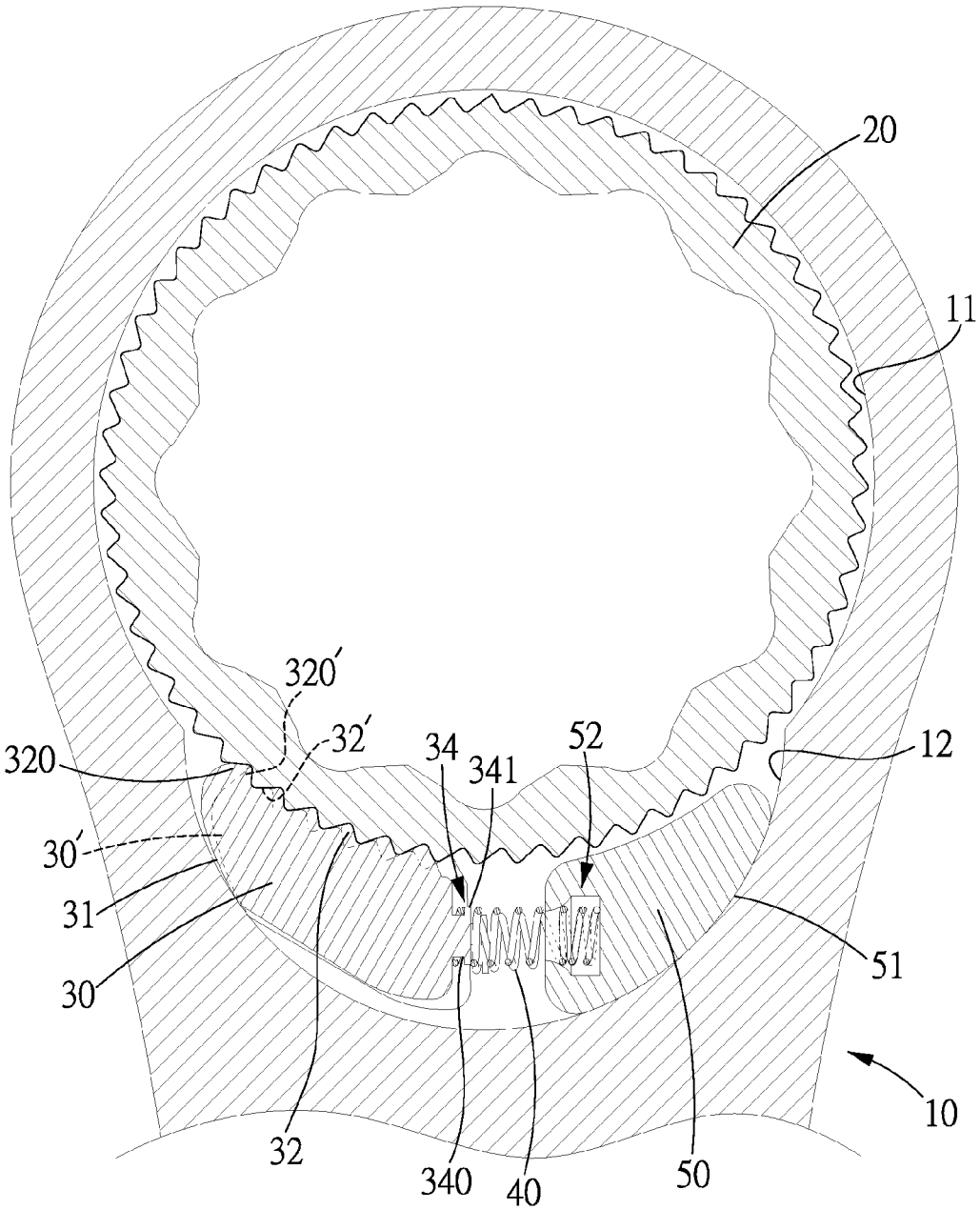
FIG. 9 is a cross-sectional view of another embodiment where the catching device has a positioning portion according to the present invention.

Referring to FIG. 9, the positioning portions 33, 33', 52 are protruding and cylindrical, and a positioning portion 34, which is protruding and cylindrical, is disposed on the catch 30, wherein a mounting portion 340 is a cylinder disposed at the thin waist of the positioning portion 34. An inserting portion 341, which is protruding and has a large diameter, is disposed at the terminal end of the mounting portion 340. The mounting portion 340 is fitted into the tip of the end portion of a corresponding one of the position-restoring elements 40 to thereby get engaged with and positioned by the inserting portion 341.

What is claimed is:

1. A one-way wrench having a catching device with two catches and a catch holder and having differential teeth, wherein the wrench has a body, a driving element, and a catching device, wherein the catching device has two catches, two position-restoring elements, and a catch holder, wherein an end of the body has a driving hole, wherein a catching chamber is laterally disposed beside the driving hole and is in communication with the driving hole, wherein the catching chamber is shallow at its two ends and deep at its middle; the driving element is externally provided with ratchet teeth and internally provided with a penetrated driving hole; the two catches have abutting ends abutting against the catching chamber, respectively; the two catches have tooth portions corresponding in position to end surfaces of the ratchet teeth, respectively; wherein a starting end of the tooth portion of one of the two catches looks like a trough, whereas a starting end of the tooth portion of another one of the two catches looks like a peak, wherein the tooth portion of one of the two catches is ahead of or lags behind the tooth portion of another one of the two catches by a half-tooth distance, wherein only one catch is engaged with and driven by the ratchet teeth of the driving element, wherein an end of each of the two position-restoring elements abuts against a corresponding one of the two catches, whereas another end of each of the two position-restoring elements abuts against the catch holder, wherein the catch holder has an abutting surface for abutting against the catching chamber, wherein the catches and the catch holder each have a positioning portion corresponding in position to the two position-restoring elements and adapted to position the two position-restoring elements in place, such that the two position-restoring elements are positioned precisely at the catch holder, and the two position-restoring elements abut precisely against the catches, respectively;

the positioning portions of the catch holder and the catches each have a mounting portion and an inserting portion, such that the position-restoring elements are fixed in place between the catch holder and the catches as soon as tips of end portions of the position-restoring elements are inserted into the positioning portions to thereby get engaged and positioned.

2. The one-way wrench of claim 1, wherein the positioning portion is a recess-shaped structure, whereas the mounting portion is a hollow-core recess structure, wherein the inserting portion is disposed at an opening of the mounting portion to render the opening narrow.

3. The one-way wrench of claim 1, wherein the positioning portion is a cylindrical structure, whereas the mounting portion is a thin-waist cylinder, wherein the inserting portion is disposed at a terminal end of the mounting portion and forms a radial protruding structure.

* * * * *